US009253580B2

(12) United States Patent
Parsi et al.

(10) Patent No.: US 9,253,580 B2
(45) Date of Patent: Feb. 2, 2016

(54) REPLACEABLE RECEIVER FOR IN-THE-EAR HEARING INSTRUMENT

(71) Applicant: SIVANTOS PTE. LTD., Singapore (SG)

(72) Inventors: Salman Parsi, Somerset, NJ (US); Anthony Strano, Highland Park, NJ (US)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/351,722

(22) PCT Filed: Oct. 12, 2012

(86) PCT No.: PCT/US2012/059948

§ 371 (c)(1),
(2) Date: Apr. 14, 2014

(87) PCT Pub. No.: WO2013/056043

PCT Pub. Date: Apr. 18, 2013

(65) Prior Publication Data

US 2014/0314263 A1 Oct. 23, 2014

Related U.S. Application Data

(60) Provisional application No. 61/546,604, filed on Oct. 13, 2011.

(51) Int. Cl.
*H04R 25/00* (2006.01)
*H04R 25/02* (2006.01)

(52) U.S. Cl.
CPC ..... *H04R 25/02* (2013.01); *H04R 25/604* (2013.01); *H04R 25/652* (2013.01); *H04R 25/658* (2013.01); *H04R 2225/023* (2013.01); *H04R 2225/025* (2013.01)

(58) Field of Classification Search
CPC ..... H04R 25/604; H04R 25/02; H04R 2225/023; H04R 25/652; H04R 25/658; H04R 225/025
See application file for complete search history.

(56) References Cited

U.S. PATENT DOCUMENTS

| | | | |
|---|---|---|---|
| 4,937,876 | A | 6/1990 | Biermans |
| 7,961,899 | B2 | 6/2011 | Van Halteren et al. |
| 8,229,150 | B2 | 7/2012 | Vonlanthen et al. |
| 2012/0243717 | A1 | 9/2012 | Lim et al. |

FOREIGN PATENT DOCUMENTS

| | | | |
|---|---|---|---|
| DE | 102008055919 | A1 | 12/2009 |
| EP | 0361594 | A1 | 4/1990 |
| EP | 1626612 | A2 | 2/2006 |
| WO | 2008116499 | A1 | 10/2008 |
| WO | 2010147554 | A1 | 12/2010 |

*Primary Examiner* — Tuan D Nguyen
(74) *Attorney, Agent, or Firm* — Laurence A. Greenberg; Werner H. Stemer; Ralph E. Locher

(57) ABSTRACT

A hearing instrument has a shell, a bottom faceplate attached to the shell, and a replaceable receiver. The receiver is replaceable through the bottom plate without removing the bottom plate from the shell. The receiver is locked in its mounting position by a mechanism that can be unlocked.

11 Claims, 5 Drawing Sheets

REPLACEABLE RECEIVER FOR IN-THE-EAR HEARING INSTRUMENT

Priority is claimed to U.S. Provisional Patent Application No. 61/546,604 filed on Oct. 13, 2011.

The present invention relates to hearing instruments, in particular In-the-Ear (ITE) hearing instruments, and hearing instrument components.

Related instruments are disclosed in U.S. patent application Ser. No. 61/362,305 and PCT application PCT/US2011/043117, having one of the named inventors of the present invention.

Two common hearing instrument types are In-the-Ear (ITE) and Behind-the-Ear (BTE). Completely-in-Canal (CIC) hearing instruments and CIC Deep Fit instruments are commonly used.

ITE hearing instruments have many advantages over BTE hearing aids, such as being more discrete, more compact, cosmetically more appealing to many users, the ability to custom match to the user's ear, among other advantages. However, one disadvantage of ITE hearing instruments is that they are more prone to require servicing than BTE hearing instruments. A major contributing factor to this higher rate of servicing is the buildup of cerumen (wax) in or around the receiver, causing clogging and/or damage to the receiver. The buildup of cerumen can cause discomfort to the user, decrease the performance of the hearing instrument, and in some cases cause the hearing instrument to become inoperable. Causing further inconvenience, the user usually has to return to the hearing aid dispenser to have the instrument serviced. Sometimes the dispenser is able to perform the required servicing on premises, but often the hearing instrument must be returned to the manufacturer to perform the required work, further inconveniencing the user and adding expense to maintenance.

The present invention provides a bottom faceplate and replaceable receiver for a hearing instrument, and a method of manufacturing such a device. A hearing instrument according the present invention comprises a shell and a receiver. The receiver is mounted on a bottom plate and is replaceable without removing the bottom plate from the shell. The receiver is locked in its mounting position by a mechanism that can be unlocked.

It is an object of the invention to teach a hearing instrument for which repair or replacement of a receiver can be performed by a user.

It is an object of the invention to teach a hearing instrument for which repair or replacement of a receiver can be performed by a hearing instrument dispenser.

It is an object of the invention to teach a hearing instrument with a bottom faceplate.

It is an object of the invention to teach a hearing instrument with a bottom faceplate through which a receiver can be moved.

It is an object of the invention to teach a hearing instrument with mechanical and electrical connections that allow easy replacement of the receiver.

It is an object of the invention to teach an ITE, CIC, or CIC Deep Fit instrument with a replaceable receiver.

Figure 1:
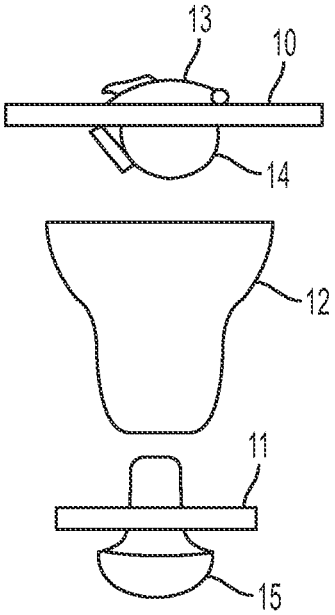
FIG. 1 shows an expanded view of an ITE hearing instrument before its modules are mounted.

An ITE hearing instrument early in the manufacturing process is shown in FIG. 1. A faceplate 10 has a battery compartment door 13 mounted on it. Additional electronic components (not shown) are also mounted on faceplate 10. Battery compartment 14 is shown, and although a battery can be placed inside the compartment at this time, the battery is usually inserted after the manufacturing process is complete. Receiver bottom plate 11 has sufficient mechanical strength for mounting a receiver (described below). Dome 15, which is replaceable, is also mounted on receiver bottom plate 11.

Figure 2:
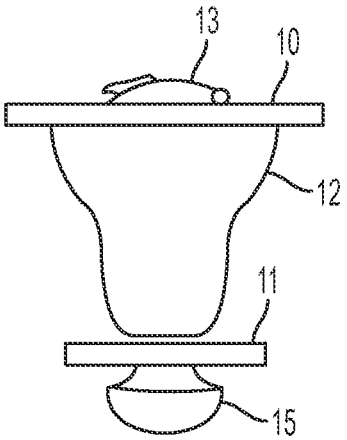
FIG. 2 shows the ITE hearing instrument with the modules mounted together.

An ITE hearing instrument further in the manufacturing process is shown in FIG. 2. Faceplate 10 and receiver bottom plate 11 are mounted on opposite sides of shell 12. The prior art teaches methods to mount faceplate 10 to shell 12, such as the use of glue. A similar or same method may be used to attach shell 12 and receiver bottom plate 11.

Figure 3:
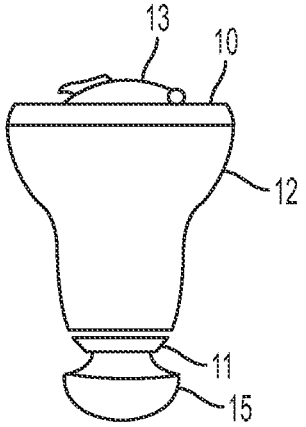
FIG. 3 shows the ITE hearing instrument after the faceplate and bottom plate are fitted to the shell.

An ITE hearing instrument toward the end of the manufacturing process is shown in FIG. 3. Faceplate 10 is fit to shell 12 using methods known in the prior art, such as cutting, grinding, and/or shaving. Similar or same methods may be used to fit bottom plate 11 to shell 12.

It is to be appreciated that the prior art teaches detailed methods of manufacturing hearing instrument components, such as making use of 3-dimensional printing to create shell 12.

Figure 4:
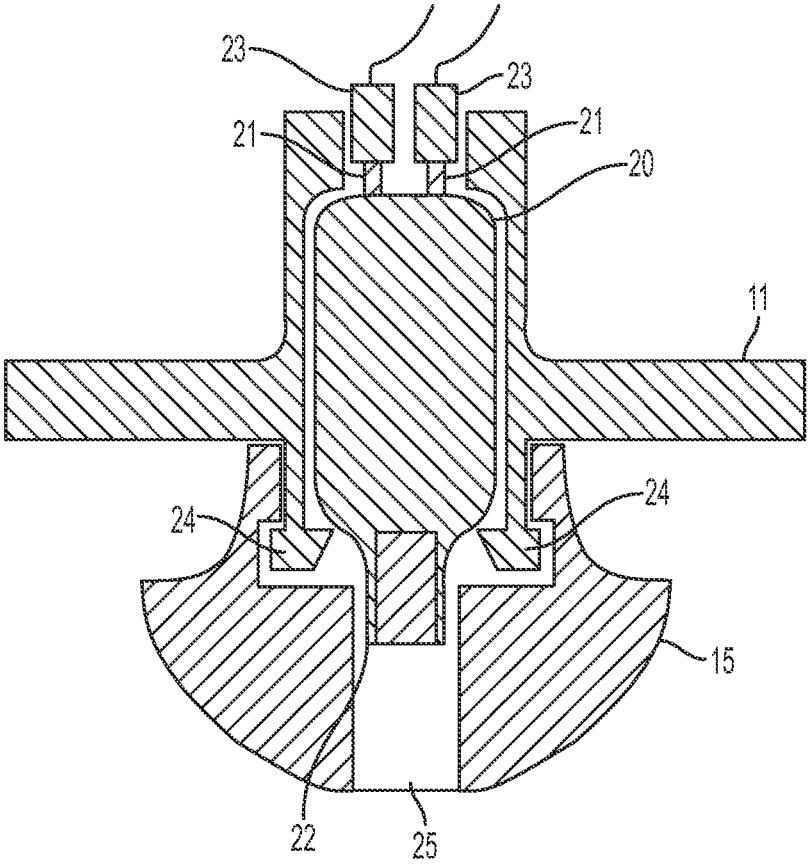
FIG. 4 is a cross-sectional view of an ITE hearing instrument having a replaceable receiver and using elastic barbs to secure the receiver and the dome.

An embodiment of the present invention is shown in the cross-sectional view of an ITE hearing of FIG. 4. Advantageously, dome 15 and receiver 20 can be removed without damaging any of the hearing instrument components. In the illustrated embodiment, the inside of elastic barbs 24 provides a snap-lock mechanism for securing receiver 20 into its mounting position when fully inserted. The illustrated embodiment also shows that while receiver 20 is properly mounted, the electrical contacts 21 fixed to receiver 20 are pushed toward the counterpart contacts 23. In order to facilitate proper electrical connection, electrical contacts 21 or counterpart contacts 23 may be elastic and/or spring-loaded.

Receiver 20 may have a spout 22 that is acoustically connected to sound channel 25 of dome 15. In the illustrated embodiment, dome 15 is mounted by sliding it over the outside of barbs 24. Advantageously, in the illustrated example dome 15 exerts pressure on the outside of barbs 24, thereby assisting barbs 24 with securing receiver 20.

Advantageously, receiver 20 is easily accessed by removing dome 15 and bending barbs 24 away from receiver 20. Receiver 20 may then be removed, cleaned, repaired, and/or replaced. Receiver 20 may then be mounted and dome 15 (or its replacement) can be slid back onto barbs 24.

Figure 5:
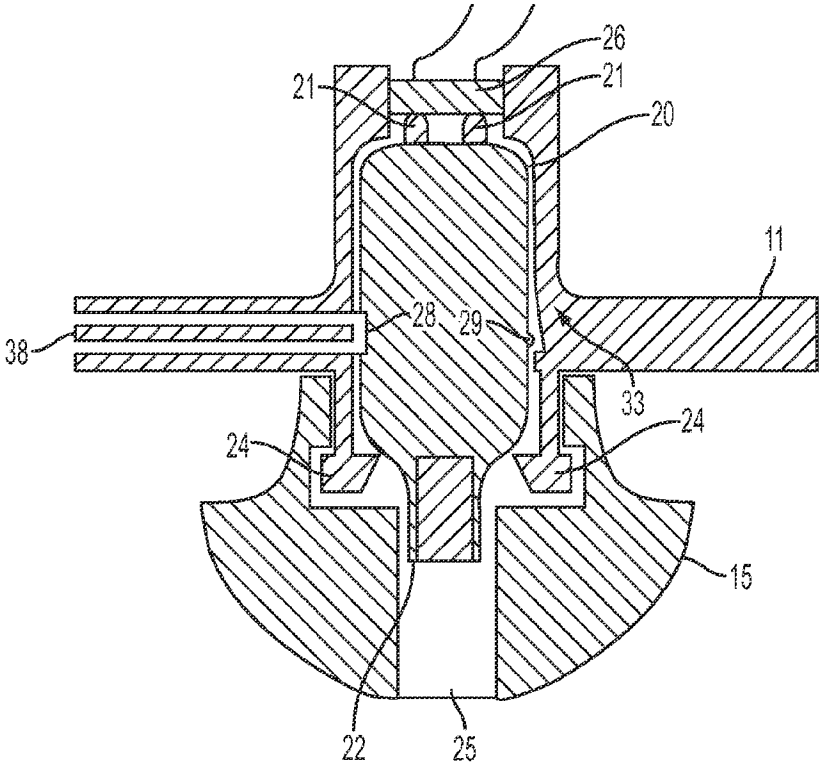
FIG. 5 is a cross-sectional view of an ITE hearing instrument having a replaceable receiver and using a pin mechanism to secure the receiver and the dome.

An alternative embodiment of the present invention is shown in FIG. 5. In this embodiment, receiver 20 has a latching mechanism 28 that locks into receiver bottom plate 11 when receiver 20 is mounted. Latching mechanism 28 utilizes pin 38 to secure receiver 20, which has a flange 29, against member 33. Preferably, pin 38 is press fit and is made of metal; however, other materials may be used. Advantageously, member 33 may be elastic and/or spring loaded to assist in securing receiver 20 when mounted. Receiver 20 is shown to have electrical contacts 21 while faceplate 11 is shown with elastomeric zebra connector 26.

It is to be appreciated that the prior art teaches detailed methods to secure a dome to a hearing instrument. Thus, rather than using the barbs shown in FIG. 5, a ball joint mechanism may be used to secure dome 15. An ideal mechanism secures dome 15 while the hearing instrument is in the ear, but allows dome 15 to be replaced when the hearing instrument is not in the ear.

Figure 6:
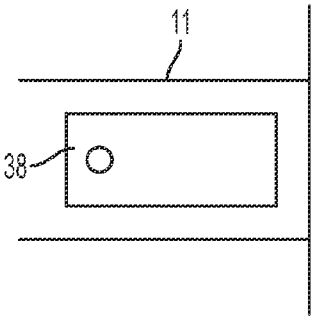
FIG. 6 shows a side view of a faceplate using a pin mechanism that secures a receiver.

A cross-sectional view of a faceplate using a pin mechanism to secure the receiver is shown in FIG. 6.

Figure 7:
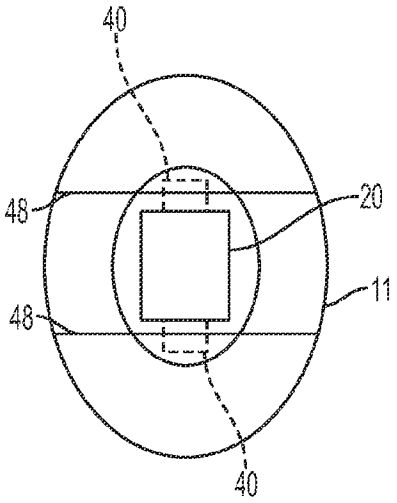
FIG. 7 shows a cross-sectional top view of faceplate using a double pin mechanism.

A cross-sectional bottom view of bottom plate 11 using a double pin mechanism is shown in FIG. 7. The pin-up mechanism is this embodiment comprises two separate pins 48 that go through bottom plate 11, which has completed the manufacturing process and therefore has been fitted to shell 12 (not shown in FIG. 7), and the cutout through which receiver 20 can be moved is also shown from this view. In this embodiment, receiver 20 has two flanges 40 that allow pins 48 to secure receiver 20. Once pins 48 are removed, receiver 20 can be moved through the cutout of bottom plate 11, and replaced if necessary.

Figure 8:
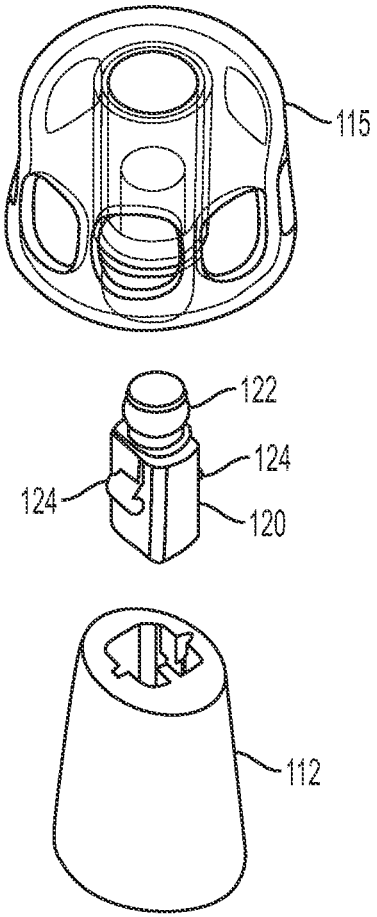
FIG. 8 shows a shell, removable receiver having tabs, and a dome.

Another alternative embodiment of the present invention is shown in FIG. 8. In this embodiment, dome 115 can be mounted directly on receiver 120 utilizing a ball joint mechanism. Receiver 120 has protrusion 122 which attaches to dome 115. Receiver 120 also has two elastic and/or spring-loaded tabs 124 which can latch onto shell 112 when receiver 120 is mounted.

Figure 9:
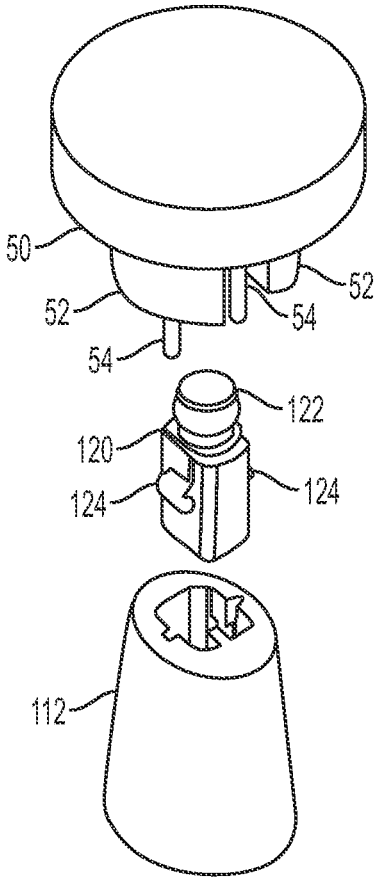
FIG. 9 shows a shell, removable receiver having tabs, and a receiver removal tool.

FIG. 9 show removal tool 50, which can be used to remove a mounted receiver 120 from shell 112. The embodiment of removal tool 50 as shown has two appendages 52, each of which has a pin 54. Advantageously, appendages 52 can wrap around protrusion 122 while pins 54 push tabs 124 toward the body of receiver 120 (shown in greater detail in FIG. 11).

Figure 10:
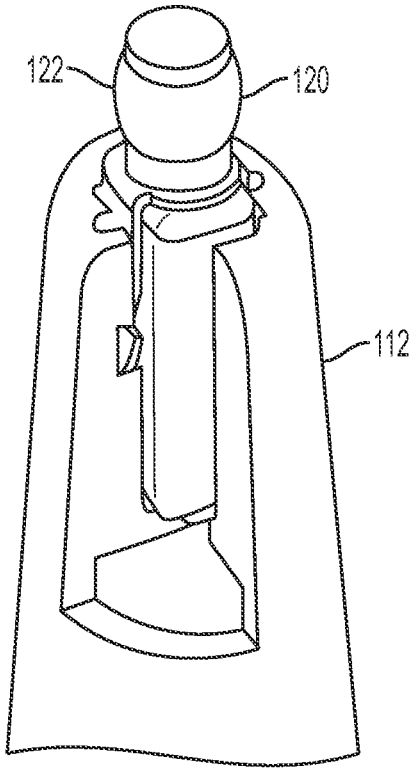
FIG. 10 shows a cut-away view of a shell and a removable receiver having tabs that is installed and substantially inside the shell.

FIG. 10 shows receiver 120 is mounted in shell 112. As shown, receiver 120 is substantially inside shell 112 when mounted.

Figure 11:
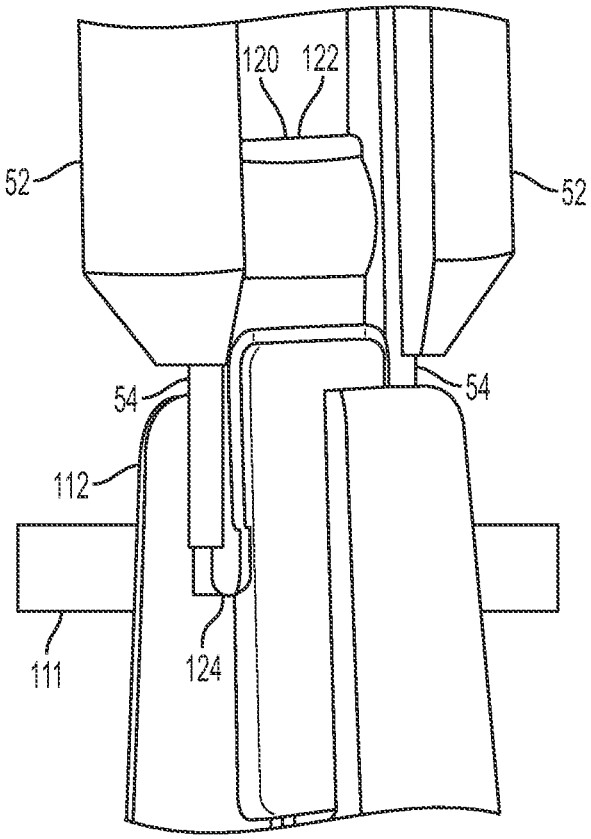
FIG. 11 shows a portion of a removal tool, a cut-away view of a shell and a cross-sectional view of a bottom plate, and a removable receiver having tabs that is substantially inside a shell and in the process of being uninstalled.

FIG. 11 shows pins 54 pushing tabs 124 toward the body of receiver 120, thereby unlatching pins 54 from shell 112. Appendages 52 squeeze receiver 120 and can be used to pull receiver 120 from shell 112 in a tweezer-like fashion. In this particular view, a cross-sectional view of bottom plate 111 is also shown.

The foregoing devices find industrial applicability in the field of hearing instruments.

What is claimed is:

1. A hearing instrument, comprising:
a shell;
a bottom plate attached to said shell; and
a receiver substantially inside said shell and mounted in said bottom plate, said receiver being replaceable through said bottom plate without removing said bottom plate from said shell, and said receiver having two elastic and/or spring-loaded tabs for latching onto said shell and defining a reversible lock.

2. The hearing instrument according to claim 1, wherein said reversible lock is a snap-lock.

3. The hearing instrument according to claim 1, wherein said reversible lock comprises at least one barb.

4. The hearing instrument according to claim 1, wherein said shell includes receptacles for receiving pins of a removal tool which push said tabs toward a body of said receiver and release said receiver from said shell.

5. A hearing instrument, comprising:
a shell;
a first faceplate attached at an end of said shell;
a receiver substantially inside of said shell; and
a second faceplate attached to an end of said shell opposite said first faceplate, said second faceplate having a securing mechanism configured to secure said receiver, said securing mechanism including at least one pin, said at least one pin being metal and press fit, and said securing mechanism being configured to allow said receiver to be moved through said second faceplate.

6. The hearing instrument according to claim 5, wherein said securing mechanism includes a snap-lock.

7. The hearing instrument according to claim 5, wherein said securing mechanism includes a flange.

8. The hearing instrument according to claim 5, wherein said securing mechanism is a latching mechanism.

9. A hearing instrument, comprising:
a shell having a first end and a second end;
a faceplate attached to said first end of said shell; and
a second faceplate attached to said second end of said shell opposite of said first faceplate, said second faceplate containing at least one pin for securing said receiver, said at least one pin being metal and press fit.

10. The hearing instrument according to claim 9, wherein said second faceplate is formed with a cutout configured to allow a receiver to be moved therethrough.

11. The hearing instrument according to claim 10, wherein said receiver has at least one flange configured to secure said receiver to said second faceplate by engaging said at least one pin.

* * * * *